US012768164B2

(12) United States Patent
Ayambem et al.

(10) Patent No.: US 12,768,164 B2
(45) Date of Patent: Oct. 20, 2026

(54) FIRE RESISTANT WALLBOARD

(71) Applicant: Panel Rey, S.A., Monterrey (MX)

(72) Inventors: Amba Ayambem, Garcia (MX); Angel Ivon Zavala Pinon, Apodaca (MX); Jorge Armando Domingez Ovalle, Mina Nuevo Leon (MX)

(73) Assignee: Panel Rey, S.A., Monterrey (MX)

( * ) Notice: Subject to any disclaimer, the term of this patent is extended or adjusted under 35 U.S.C. 154(b) by 118 days.

(21) Appl. No.: 18/907,147

(22) Filed: Oct. 4, 2024

(65) Prior Publication Data

US 2025/0116110 A1 Apr. 10, 2025

Related U.S. Application Data

(60) Provisional application No. 63/590,567, filed on Oct. 16, 2023, provisional application No. 63/588,837, filed on Oct. 9, 2023.

(51) Int. Cl.
*E04B 2/72* (2006.01)
*E04B 2/74* (2006.01)

(52) U.S. Cl.
CPC ..... *E04B 2/723* (2013.01); *E04B 2/7403* (2013.01)

(58) Field of Classification Search
CPC ..... E04B 1/942; E04B 2/7403; E04B 2/723; B32B 13/02; B32B 2307/3065
See application file for complete search history.

(56) References Cited

U.S. PATENT DOCUMENTS 4,686,135 A * 8/1987 Obayashi ..... B32B 27/308 428/476.3
7,776,170 B2 * 8/2010 Yu ..... E04F 13/04 156/39
2011/0091713 A1 * 4/2011 Miller ..... E04B 1/942 428/312.2
2012/0291377 A1 * 11/2012 Riebel ..... B32B 27/36 428/480
2013/0210303 A1 * 8/2013 Doi ..... B32B 27/18 428/688
2015/0284638 A1 * 10/2015 Xu ..... B32B 15/046 428/317.9
2017/0030076 A1 * 2/2017 Li ..... E04C 2/043
2018/0119417 A1 * 5/2018 Li ..... E04B 1/942
2019/0003176 A1 * 1/2019 Donelan ..... B32B 29/02
2019/0352233 A1 * 11/2019 Vilinska ..... B32B 13/08
2020/0392050 A1 * 12/2020 Li ..... C04B 41/4535
2021/0187925 A1 * 6/2021 Hill ..... B32B 5/18
2021/0230865 A1 7/2021 Fisler et al.
2021/0238096 A1 8/2021 Li et al.
2024/0157675 A1 * 5/2024 Stav ..... C04B 18/146
2025/0091321 A1 * 3/2025 Evans ..... B32B 5/022
2025/0303676 A1 * 10/2025 O'Neil ..... B32B 5/18

OTHER PUBLICATIONS

Xu et al., "Influence of Carbon Nanoparticle Geometry on the Fire Resistance and Anti-Aging Properties of Intumescent Fire-Retardant Coatings", Fire and Materials 46.4, Jul. 13, 2021; 11 pages.

* cited by examiner

*Primary Examiner* — Christine T Cajilig

(74) *Attorney, Agent, or Firm* — Smith, Gambrell & Russell, LLP; Dale Lischer

(57) ABSTRACT

A fire resistant wallboard with carbon black and expandable graphite. A carbon black layer is positioned between the conventional cover sheet and a gypsum core with embedded expandable graphite. The carbon black layer may be employed either with one of the cover sheets or with both of the cover sheets.

8 Claims, 2 Drawing Sheets

FIRE RESISTANT WALLBOARD

CROSS REFERENCE TO RELATED PATENT APPLICATIONS

This invention claims priority from U.S. Provisional Patent Application No. 63/588,837, filed Oct. 9, 2023, and U.S. Provisional Patent Application No. 63/590,567, filed Oct. 16, 2023, which are hereby incorporated by reference.

FIELD OF THE INVENTION

This invention relates to a gypsum wallboard construction that retards thermal transmission from one side of the gypsum wallboard to the other when one side is exposed to flames.

BACKGROUND OF THE INVENTION

Fire resistance of a wallboard is measured according to ASTM E119, where a series of wallboard panels are exposed to a furnace. A number of thermocouples are affixed to predetermined locations on the opposite side of the wall that is not exposed to direct fire from the furnace. To be certified as having passed this ASTM E119 fire test, none of the thermocouples should exceed readings of 325° F. plus ambient temperature in less than 60 minutes, or the average value of the thermocouples should remain less than 250° F. plus ambient temperature for a minimum of 60 minutes.

When gypsum wallboard is exposed to a high temperature, the gypsum (calcium sulfate dihydrate) that makes up the wallboard's core undergoes a dehydration reaction which first converts gypsum to calcium sulfate hemihydrate and then to calcium sulfate. This series of reactions involve the release of water molecules which help to temporarily insulate the wallboard and slow the transfer of heat from the fire-exposed side to the other, unexposed side. At the same time that these reactions are taking place and water is being evolved, the gypsum wallboard is shrinking to compensate for the loss of water. In turn, this internal shrinkage of the wallboard panels eventually creates gaps at the joints, exposing the mounting studs to direct contact with the furnace fire. These studs, whether wood or metal, burn or significantly accelerate the transmission of heat to the unexposed side of the wallboard panels and eventually result in failure of the test. So, being able to pass the fire test involves mitigating heat transfer across the wallboard and minimizing or eliminating board shrinkage. This shrinkage has conventionally been achieved by incorporating and distributing vermiculite into the gypsum core. Vermiculite is comprised of an insulating surface but more importantly, it expands when heated. After heating for one hour, high expansion vermiculite particles could expand to about 300% or more of their original volume. In any case, the expansion of vermiculite particles that have been distributed within a gypsum wallboard core helps to retain the structural integrity of the wallboard structure when the board is exposed to intense heat. As the gypsum core contracts in response to loss of water molecules, the vermiculite expands to achieve a counterbalance.

Li et al. U.S. Pat. No. 10,604,929 provides an example of the use of vermiculite within the gypsum core to increase fire resistance.

SUMMARY OF THE INVENTION

In the present invention, a combination of expandable graphite and carbon black is used in a gypsum wallboard construction to mitigate heat transfer from a fire-exposed side of the wallboard panel to the unexposed side. In the current invention, a small quantity of carbon black is dispersed in the layer of gypsum just below the face paper of the gypsum wallboard. A small quantity of expandable graphite is dispersed in the rest of the gypsum core of the wallboard. When heated, the expandable graphite particles expand as much as 1000-fold. In this inventive construction, the combination of the thermal insulation provided by the carbon black layer and the shrinkage mitigation provided by the expansion of expandable graphite has shown results that are superior to traditional systems containing vermiculite alone.

Shrinkage is determined by cutting a 2"×5" piece of the wallboard and then measuring the thickness at four locations on the piece of board. The board is then placed in a furnace at 538° C. for a duration of 30 minutes after which thickness measurements of the same four spots on the board are taken again. The difference between the average thickness before placing in the oven and the average thickness after placing in the oven is recorded as the shrinkage. The higher that the number is, the higher the shrinkage. A negative number would indicate a net expansion.

Further objects, features and advantages will become apparent upon consideration of the following detailed description of the invention when taken in conjunction with the appended claims.

DETAILED DESCRIPTION OF THE PREFERRED EMBODIMENTS

Figure 1:
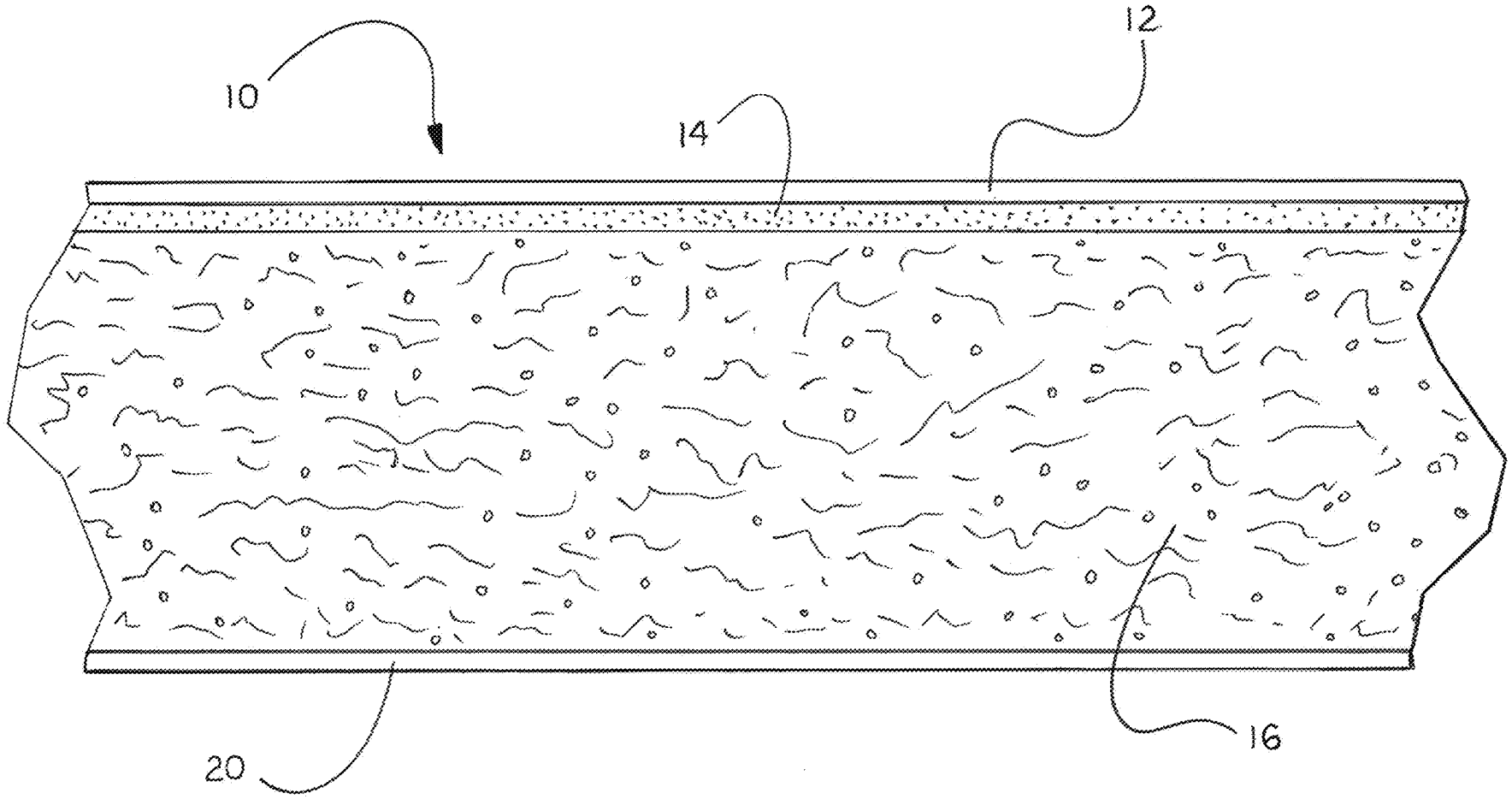
FIG. 1 is a photographic cross-section view of a first embodiment of a fire resistant wallboard in accordance with the present invention.

FIG. 1 shows a cross-section of a fire resistant wallboard 10 that exposes the various layers of the fire resistant wallboard 10 of the present invention. Beginning in order from the front of the wallboard 10 to the back of the wallboard 10, the wallboard 10 includes the following layers. A front cover sheet 12, a front carbon black layer 14, a gypsum+expandable graphite core 16, and a back cover sheet 20.

The front cover sheet 12 and the back cover sheet 20 are conventional paper cover sheets used in conventional wallboard construction.

The front carbon black layer 14 is formed of carbon black. The front carbon black layer 14 is between 8 mil (0.008 inch, 0.2032 mm) and 15 mil (0.015 inch, 0.381 mm) thick. The carbon black layer 14 extends over the full length and width of the wallboard 10. The front carbon black layer 14 is Thermax N991, manufactured by CanCarb of Medicine Hat, Alberta, Canada. As shown in Table 1, Thermax in 991 has the following characteristics.

TABLE 1

| Parameter | ASTM Test Method | Thermax N991 Powder |
|---|---|---|
| Sieve Residue 325 Mesh % (ppm) max. | D1514 | 0.0250 (250) |

TABLE 1-continued

| Parameter | ASTM Test Method | Thermax N991 Powder |
|---|---|---|
| Magnetics on 325 Mesh % (ppm) max. | | 0.0005 (5) |
| Nitrogen Surface Area, m2/g | D6556 | 7.0-12.0 |
| Oil Absorption Number (OAN) cm3/100 g max. | D2414 | 44.0 |
| Ash Content % max. | D1506 | 0.20 |
| pH | D1512 | 9.0-11.0 |
| Toluene Extract % max. | | 0.50 |
| Heat Loss % max. | D1509 | 0.1 |

In the process of manufacturing the wallboard of the present invention, the carbon black layer is deposited on the front cover sheet 12 before being married to the gypsum+expandable graphite core 16.

The gypsum+expandable graphite core 16 comprises a mixture of a conventional gypsum core and expandable graphite evenly distributed throughout the core 16. The core 16 comprises approximately 16 pounds per MSF (thousand square feet) of the finished core 16. Two different grades of expandable graphite, 3494 and 3570 manufactured by Asbury Graphite of North Carolina, Inc. of Lumberton North Carolina, can be used for the core 16. Specifications for expandable graphite 3494 and expandable graphite 3570 are shown in Table 2 and Table 3 below.

TABLE 2

Expandable Graphite 3494
General Product Description

| | Minimum | Maximum |
|---|---|---|
| % Moisture | 0 | 3 |
| % ExpCarb | 80 | 100 |
| % +50 Mesh (300 Micron) | 0 | 5 |
| % −200 Total (75 Micron) | 0 | 25 |
| Expansion Ratio X:1 | 70 | 130 |
| pH | 1 | 6 |

TABLE 3

Expandable Graphite 3570
General Product Description

| | Minimum | Maximum |
|---|---|---|
| % Ash 0 10 | 0 | 10 |
| % Moisture 0 2 | 0 | 2 |
| % ExpCarb | 90 | 100 |
| % +100 Total (150 Micron) | 85 | 100 |
| Expansion Ratio X:1 | 215 | 300 |
| pH | 5 | 10 |

A control formula for a gypsum core wallboard contains 60 lbs./MSF of vermiculite VCX 204 supplied by Specialty Vermiculite Corp. of Enoree, South Carolina. The specification for the vermiculite is shown in Tables 4, 5, and 6.

TABLE 4

Typical Properties of VCX Vermiculite

| Property | Typical Value |
|---|---|
| Color | Dark greenish brown to golden brown |
| Shape | Flake |
| Angle of Repose | 27-45° |

TABLE 4-continued

Typical Properties of VCX Vermiculite

| Property | Typical Value |
|---|---|
| Solubility | Insoluble in water |
| Aspect Ratio | 20-40 |
| Surface Area (a) | 0.5-1.0 ($m^2$/gm) |
| Mohs Hardness | 1.5-2.0 (Nonabrasive) |
| Specific Gravity | 2.4-2.8 |
| Bulk Density | 40-65 (lbs/$ft^3$) 640-1,041 (kg/$m^3$) |
| Refractive Index | $\alpha$ = 1.52-1.57<br>$\beta$, y = 1.54-1.61 |
| Moisture Content | 6.5% (heated to 250° F., 110° C.) |
| Total Ignition Loss | 8.0-20.0% (at 2000° F., 1100° C) |
| pH (in water) | 6-8 |
| Expansion | ≈10X (Volume Change) |
| Expansion Temperature | 1100-1800° F. (580-970° C.) |
| Sintering Temperature | 2100-2200° F. (1150-1200° C.) |
| Fusion Point | 2200-2400° F. (1200-1300° C.) |
| Cation Exchange Capacity | 50-100 (m. θ./100 g) |

(a) B.E.T. values obtained by nitrogen adsorption technique

TABLE 5

Chemical Formula
$(Mg, Ca, K, Fe^{II})_3 (Si, AI, Fe^{III})_4 O_{10} (OH)_2 \bullet 4H_2O$
Typical Chemical Analysis [b]

| Element[b] | % by Weight |
|---|---|
| $SiO_2$ | 36-46 |
| MgO | 16-24 |
| $AI_2O_3$ | 11-16 |
| $Fe_2O_3$ | 8-13 |
| $K_2O$ | 4-6 |
| CaO | 1-3 |
| $TiO_2$ | 1-3 |
| MnO | 0.1-0.2 |
| $Cr_2O_3$ | 0.05-0.2 |
| $Na_2O$ | 0.1-0.3 |
| Other | 0.0-0.5 |

[b]Elements are expressed as oxide

TABLE 6

Typical VCX ™ Particle Size
% Weight Retained On Each Screen
Vermiculite Grade

| U.S. Screens | Mm | VCX 203 | VCX 204 | VCX 205 |
|---|---|---|---|---|
| 8 | 2.36 | | | |
| 12 | 1.70 | 0-10 | | |
| 16 | 1.18 | 10-35 | | |
| 20 | 0.85 | 25-40 | | |
| 30 | 0.60 | 20-40 | | 0-1 |
| 40 | 0.425 | 2-14 | 24-40 | |
| 50 | 0.30 | 0-8 | 24-38 | 0-20 |
| 70 | 0.212 | 0-7 | 10-20 | |
| 100 | 0.15 | | 0-15 | 30-76 |
| −100 pan | <0.15 | | | |

A small-scale fire test that is reflective of full furnace ASTM E119 tests involves cutting out a 7.5 inch×7.5 inch size of the test wallboard 10, locating the exact center point of the front cover sheet 12 of wallboard 10, and then affixing a thermocouple to the back (unexposed) cover sheet 20 at the center point location. A blowtorch flame is directed to the center point on the front cover sheet 12 (at a predetermined distance from the front cover sheet 12), and the temperature readings of the thermocouple located on the back cover sheet 20 of the side opposite of the flame are monitored.

The control wallboard containing vermiculite experienced a net shrinkage of 5/1000 inch, and when heated by way of the blow torch fire test, the back cover sheet of this control wallboard required about 60 minutes to reach 670° F. Table 7 shows these results, along with results for various levels of expandable graphite being added to the paper/core slurry and separately, to the gypsum core slurry. Table 7 shows that a mixture of 1.3 lbs./MSF of expandable graphite Grade 3538 (supplied by Asbury Graphite) in the paper/core layer and 9.3 lbs./MSF in the core displayed both lower shrinkage and a longer time to get to 670° F. than the control wallboard. The dosage range of expandable graphite in the core is 3.0 to 30.0 lbs/MSF (based on total dosage of gypsum in the wallboard)

TABLE 7

| Raw material | Paper/ Core Layer Dosage in lb/MSF | Gypsum Core Dosage in lb/MSF | Shrinkage 1/1000 in | Time to reach 670° F (min) |
|---|---|---|---|---|
| Vermiculite VCX 204 (control) | 0 | 60 | 5 | 60 |
| Asbury EG Grade 3538 | 1.3 | 0 | 42 | 176 |
| Asbury EG Grade 3538 | 2.0 | 0 | 63 | 66 |
| Asbury EG Grade 3538 | 1.3 | 0 | −97 | 131 |
| Asbury EG Grade 3494 | 0 | 12.2 | | |
| Asbury EG Grade 3538 | 1.3 | 0 | 4 | 84 |
| Asbury EG Grade 3494 | 0 | 9.3 | | |

Table 8 shows results of gypsum wallboards which were made by dosing the paper/core slurry and the core with various levels of carbon black and expandable graphite. The dosage range of carbon black in the carbon black layer is 0.5 to 5.0 lbs/MSF (based on total dosage of gypsum in the wallboard).

Table 8 shows that the mixture of 2.6 lbs./MSF of Thermax N991 carbon black in the paper/core slurry along with 16 lbs./MSF of expandable graphite Grade 3494 had superior performance in both shrinkage and thermal transmission than the control vermiculite wallboard.

TABLE 8

| Raw material | Paper/ Core Layer Dosage in Lb/MSF | Gypsum Core Dosage in Lb/MSF | Shrinkage 1/1000 in | Time to reach 670 F. (min) |
|---|---|---|---|---|
| Carbon Black Thermax N990 | 2.6 | 0 | 41 | 30 |
| Carbon Black Thermax N991 | 2.6 | 0 | 41 | 52 |
| Carbon Black Thermax N991UP | 2.6 | 0 | 41 | 38 |
| Vermiculite VCX 204 | 0 | 30 | 31 | 34 |
| Carbon Black Thermax N990 | 2.6 | 0 | | |
| Vermiculite VCX 204 | 0 | 30 | 33 | 48 |
| Carbon Black Thermax N991 | 2.6 | 0 | | |
| Vermiculite VCX 204 | 0 | 30 | 31 | 44 |
| Carbon Black Thermax N991UP | 2.6 | 0 | | |
| Vermiculite VCX 204 | 0 | 30 | 30 | 38 |
| Carbon Black Thermax N991 | 2.6 | 0 | −12 | 120 |
| Asbury EG Grade 3538 | 0 | 65 | | |
| Carbon Black Thermax N991 | 2.6 | 0 | 1 | 68 |
| Asbury EG Grade 3570 | 0 | 10 | | |
| Carbon Black Thermax N991 | 2.6 | 0 | −8 | 90 |
| Asbury EG Grade 3494 | 0 | 16 | | |
| Carbon Black Thermax N991 | 2.6 | 0 | 6 | 115 |
| Asbury EG Grade 3494 | 0 | 16 | | |
| Vermiculite VCX 204 | 0 | 60 | 5 | 60 |

Figure 2:
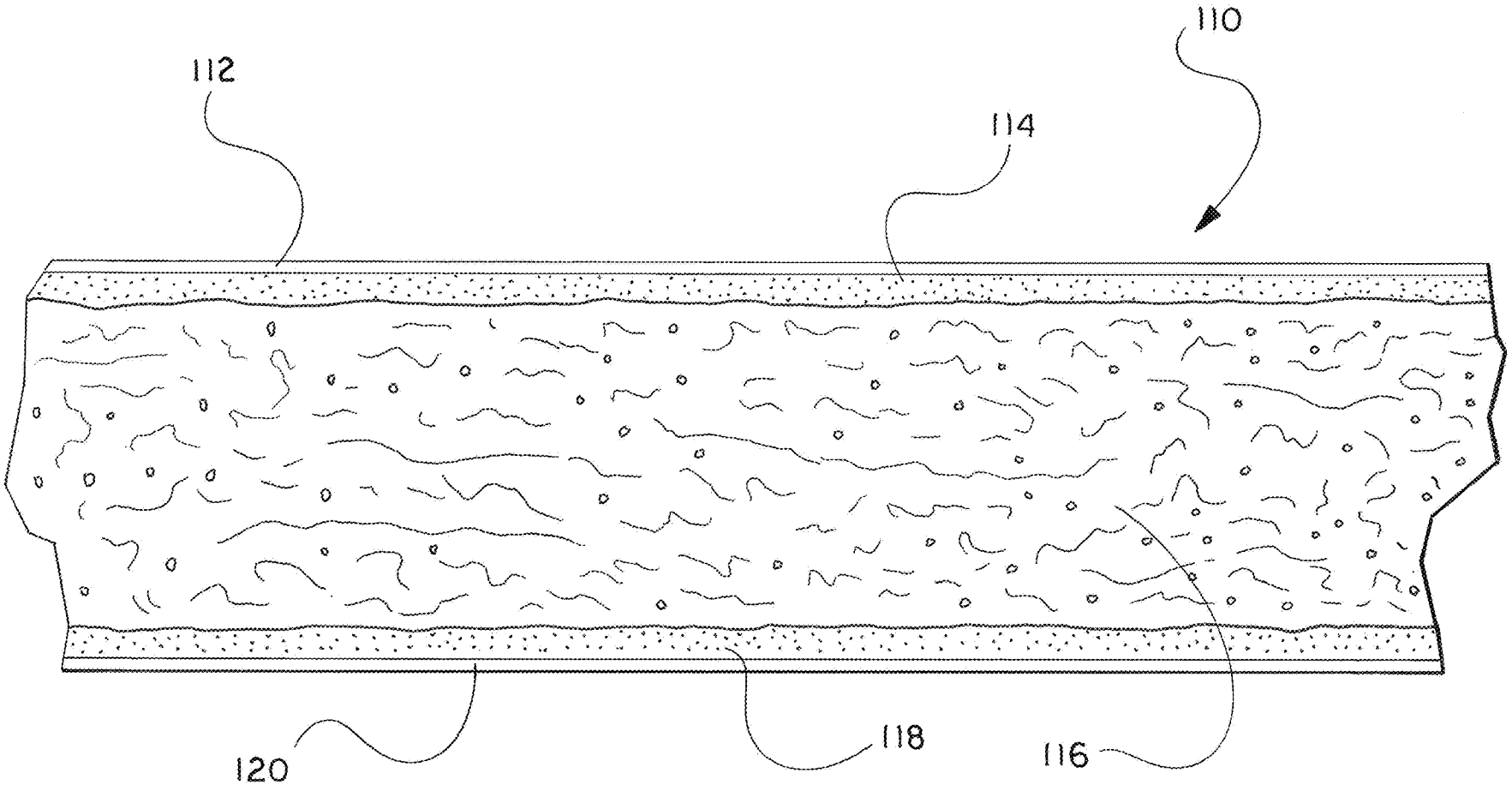
FIG. 2 is a photographic cross-section view of a second embodiment of a fire resistant wallboard in accordance with the present invention.

Turning to FIG. 2, the construction of the fire resistant wallboard 110 is in most regards the same as fire resistant wallboard 10 of FIG. 1 in that elements 110, 112, 114, 116, and 120 of FIG. 2 correspond to and are the same as elements 10, 12, 14, 16, and 20 of FIG. 1. The fire resistant wallboard 110, however, has an additional carbon black layer 118 between the back cover sheet 120 and the gypsum+expandable graphite core 116. The additional carbon black layer 118 has the same characteristics as the carbon black layer 14 shown in FIG. 1. The additional carbon black layer 118 provides additional insulation between any flames at the front cover sheet 112 and temperatures experienced at the back cover sheet 120.

While this invention has been described with reference to preferred embodiments thereof, it is to be understood that variations and modifications can be affected within the spirit and scope of the invention as described herein and as described in the appended claims.

We claim:

1. A fire resistant wallboard comprising in order:

a. a front cover sheet;

b. a front carbon black layer;

c. a core comprising a mixture of gypsum and expandable graphite; and d. a back cover sheet, wherein the front carbon black layer is positioned between the front cover sheet and the gypsum core.

2. The fire resistant wallboard of claim 1, wherein the front carbon black layer is between 8 mil and 15 mil thick.

3. The fire resistant wallboard of claim 1, wherein front carbon black layer dosage is between 0.5 to 5.0 lbs/MSF.

4. The fire resistant wallboard of claim 1, wherein expandable graphite dosage in the core is between 3.0 to 30.0 lbs/MSF.

5. A fire resistant wallboard comprising in order:

a. a front cover sheet;

b. a front carbon black layer;

c. a core comprising a mixture of gypsum and expandable graphite;

d. a back carbon black layer; and e. a back cover sheet, wherein the front carbon black layer is positioned between the front cover sheet and the gypsum core and the back carbon black layer is positioned between the back cover sheet and the gypsum core.

6. The fire resistant wallboard of claim 5, wherein the front carbon black layer and the back carbon black layer are between 8 mil and 15 mil thick.

7. The fire resistant wallboard of claim 5, wherein front carbon black layer dosage and back carbon black layer dosage are between 0.5 to 5.0 lbs/MSF.

8. The fire resistant wallboard of claim 5, wherein expandable graphite dosage in the core is between 3.0 to 30.0 lbs/MSF.

* * * * *